US008505906B2

(12) United States Patent
Kawachi et al.

(10) Patent No.: US 8,505,906 B2
(45) Date of Patent: Aug. 13, 2013

(54) SHEET CONVEYANCE DEVICE AND IMAGE FORMING APPARATUS USING THE SAME DEVICE

(75) Inventors: Kunihiro Kawachi, Kokubunji (JP); Kyoichi Mizuno, Tama (JP); Masahiro Matsuo, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 23 days.

(21) Appl. No.: 12/624,688

(22) Filed: Nov. 24, 2009

(65) Prior Publication Data

US 2010/0133738 A1 Jun. 3, 2010

(30) Foreign Application Priority Data

Dec. 1, 2008 (JP) ..... 2008-306708

(51) Int. Cl.
*B65H 3/06* (2006.01)

(52) U.S. Cl.
USPC ..... 271/119; 271/109; 271/114

(58) Field of Classification Search
USPC ..... 271/119, 109, 114, 117, 118, 121
See application file for complete search history.

(56) References Cited

U.S. PATENT DOCUMENTS 4,443,006 A * 4/1984 Hasegawa ..... 271/10.11
4,653,742 A * 3/1987 Sasaki et al. ..... 271/114
4,696,462 A * 9/1987 Tanaka et al. ..... 271/10.11
4,958,825 A * 9/1990 Onomoto et al. ..... 271/119
5,203,553 A * 4/1993 Chiang ..... 271/3.18
5,390,906 A * 2/1995 Ishii ..... 271/10.04
5,423,526 A * 6/1995 Hasegawa ..... 271/10.13

FOREIGN PATENT DOCUMENTS

JP 55074927 A * 6/1980
JP 01236128 A * 9/1989
JP 4-173631 A 6/1992
JP 04173631 A * 6/1992
JP 5-14042 U 2/1993
JP 7-25491 A 1/1995
JP 2001-63841 A 3/2001

OTHER PUBLICATIONS

Notice of Reasons for Refusal for Japanese Patent Application No. 2008-306708, mailed Oct. 2, 2012, with English translation.

* cited by examiner

*Primary Examiner* — Luis A Gonzalez
(74) *Attorney, Agent, or Firm* — Cantor Colburn LLP

(57) ABSTRACT

A sheet conveyance device to convey a sheet which is stored within a sheet storing section, including: a plurality of sheet conveyance rollers, mounted on a sheet storing section, to be parallel to each other with respect to rotating centers, wherein the plurality of the sheet conveyance rollers come into contact with the sheet to convey the sheet toward an exterior of the sheet conveyance device; and a coupling section to couple the plurality of the sheet conveyance rollers and to rotate the plurality of the sheet conveyance rollers, wherein at least one of the plurality of the sheet conveyance rollers represents an irregularly shaped roller, wherein the irregularly shaped roller is coupled to another sheet conveyance roller by the coupling section, and wherein a distance between a rotation center and a peripheral surface of the irregularly shaped roller is inconstant, in a rotational direction of the irregularly shaped roller.

3 Claims, 10 Drawing Sheets

SHEET CONVEYANCE DEVICE AND IMAGE FORMING APPARATUS USING THE SAME DEVICE

CROSS REFERENCE TO RELATED APPLICATION

This application is based on Japanese Patent Application No. 2008-306,708 filed on Dec. 1, 2008 with the Japanese Patent Office, the entire content of which is hereby incorporated by reference.

TECHNICAL FIELD

The present invention relates to a sheet conveyance device, having a function in which a sheet is puckered between rollers so that the uppermost sheet is separated from a bundle of sheets, and said device being applicable to printers, copying machines, or associated image forming apparatuses, and in particular, relates to an image forming apparatus, using the same sheet conveyance device.

BACKGROUND ART

In recent years, since image printing technologies have been improved, images can be formed on various media, such as normal sheets, coated sheets, and sheets used for OHP (being an overhead projector). However, these sheets exhibit a higher contacting force between each sheet, so that sheets are not easily separated, and consequently, superposed sheets are too often conveyed. In order to prevent the superposed sheets from being conveyed, a sheet conveyance device has been developed, in which each sheet is puckered so that the sheet is easily separated.

Generally, in the sheet conveyance device, two conveyance rollers, each contacting the sheet, rotate at different rotation times so that the sheets are separated one by one.

In Unexamined Japanese Patent Application Publication No. 7-25,491 (see page 3, and FIG. 1), a sheet conveyance device, featuring a timing pulley, is disclosed. Said device is structured of a first sheet supplying roller, a second sheet supplying roller, a timing belt, and timing pulleys. One of the timing pulleys is attached to the first sheet supplying roller, while the other is attached to the second sheet supplying roller. Around each timing pulley, said timing belt is entrained. A rotation starting time is determined so that when a predetermined time interval has passed after the first sheet supplying roller began to rotate, then the second sheet supplying roller begins to rotate. Due to the time difference between rotation starting times of the first and second sheet supplying rollers, said sheet conveyance device forms a pucker on the sheet contacted to the first and second sheet supplying rollers, whereby each sheet is easily separated.

However, since the above patent application includes the timing pulley to form a pucker on the sheet, the device becomes quite large and complicated. Further, the production cost of the device itself increases.

SUMMARY OF THE INVENTION

To solve the above problems, the present invention is designed to offer a sheet conveyance device and an image forming apparatus, exhibiting reduced manufacturing cost, but at high reliability, wherein to simplify the structure of said device and apparatus, the number of the structuring parts is reduced compared to that of conventional devices, whereby the overall size of the device is downsized.

An aspect of the present invention will be detailed below.

A sheet conveyance device to convey a sheet stored in a sheet storing section, including:

a plurality of sheet conveyance rollers, mounted on a sheet storing section, to be parallel to each other with respect to rotating centers, wherein the plurality of the sheet conveyance rollers come into contact with the sheet to convey the sheet toward an exterior of the sheet conveyance device; and a coupling section to couple the plurality of the sheet conveyance rollers and to rotate the plurality of the sheet conveyance rollers, wherein at least one of the plurality of the sheet conveyance rollers represents an irregularly shaped roller, wherein the irregularly shaped roller is coupled to another sheet conveyance roller by the coupling section, and wherein a distance between a rotation center and a peripheral surface of the irregularly shaped roller is inconstant, in a rotational direction of the irregularly shaped roller.

Another aspect of the present invention will be detailed below.

An image forming apparatus, including:

an image forming section to form an image on an image carrier; and a sheet conveyance device to supply successive sheets to the image carrier, wherein the sheet conveyance device includes a plurality of conveyance rollers mounted on a sheet storing section, to be parallel to each other with respect to rotating centers, wherein the plurality of the sheet conveyance rollers come into contact with the sheet to convey the sheet to the image carrier; and a coupling section to couple the plurality of the sheet conveyance rollers and to rotate the plurality of the sheet conveyance rollers, wherein at least one of the plurality of the sheet conveyance rollers represents an irregularly shaped roller, wherein the irregularly shaped roller is coupled to another sheet conveyance roller by the coupling section, and wherein a distance between a rotation center and a peripheral surface of the irregularly shaped roller is inconstant, in a rotational direction of the irregularly shaped roller.

BRIEF DESCRIPTION OF THE DRAWINGS

Embodiments will now be described, by way of example only, with reference to the accompanying drawings which are meant to be exemplary, not limiting, and wherein like elements are numbered alike in the several figures, in which.

DETAILED DESCRIPTIONS OF THE PREFERRED EMBODIMENTS

Figure 1:
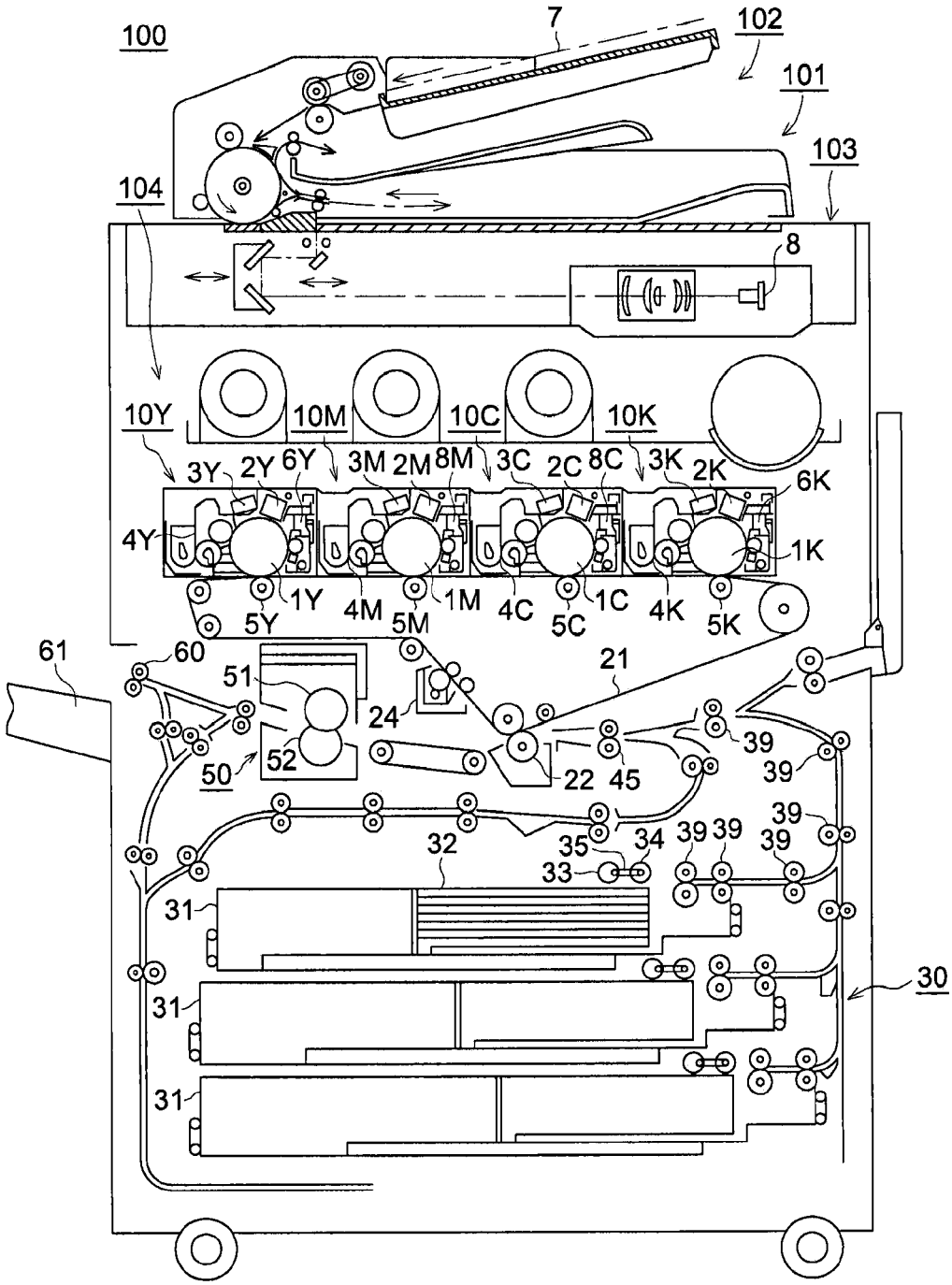
FIG. 1 is a schematic view of image forming apparatus 100 relating to Embodiment 1.

The sheet conveyance device and the image forming apparatus, relating to the present invention, will now be detailed while referring to the drawings. In the present embodiment, an image copier is detailed as an example of image forming apparatus 100.

<Embodiment 1>

[Constitutional Example of Image Forming Apparatus 100]

FIG. 1 is a schematic drawing to show a constitutional example of image forming apparatus 100, relating to Embodiment 1 of the present invention. In FIG. 1, image forming apparatus 1 is structured of image forming section 104, image reading device 101, sheet conveyance device 30, and image fixing device 50. Image forming section 104 is referred to as a tandem type full color image forming section, said image forming section 104 is structured of image forming units 10Y, 10M, 10C and 10K, intermediate transfer body 21, secondary transfer section 22, and cleaning section 24 to clean intermediate transfer body 21.

Image reading device 101, structured of automatic document feeding device 102, and scanning exposure device 103, is provided above image forming section 104. Original document 7, placed on a platen of automatic document feeding device 102, is conveyed by a conveyance section, which is not illustrated. Images, formed on a single surface or both surfaces of original document 7, are scanned to be exposed by an optical system of scanning exposure device 103, whereby the exposed images are read by line image sensor 8 which is structured of a CCD, or the like. After read images are photoelectrically converted by line image sensor 8, the images are processed via an analog process, an A/D conversion, a shading correction means, and an image compression means, after which the processed images are subsequently conveyed to exposure sections 3Y, 3M, 3C and 3K.

Image forming unit 10Y, which forms yellow images, includes electrical charging section 2Y, exposure section 3Y, development section 4Y, primary transfer section 5Y, and cleaning section 6Y, which are arranged around photo conductive drum 1Y.

Image forming unit 10M, which forms magenta images, includes electrical charging section 2M, exposure section 3M, development section 4M, primary transfer section 5M, and cleaning section 6M, which are arranged around photo conductive drum 1M.

Image forming unit 10C, which forms cyan images, includes electrical charging section 2C, exposure section 3C, development section 4C, primary transfer section 5C, and cleaning section 6C, which are arranged around photo conductive drum 1C.

Image forming unit 10K, which forms black images, includes electrical charging section 2K, exposure section 3K, development section 4K, primary transfer section 5K, and cleaning section 6K, which are arranged around photo conductive drum 1K.

Electrical charging sections 2Y, 2M, 2C, and 2K, and exposure sections 3Y, 3M, 3C, and 3K are configured to structure latent image forming sections, that is, said electrical charging sections 2Y, 2M, 2C, and 2K, and exposure sections 3Y, 3M, 3C, and 3K are configured to form electrostatic latent images on photoconductive drums 1Y, 1M, 1C, and 1K.

Recording sheet conveyance device 30 is structured of conveyance rollers 33 and 34, and coupling belt 35. Further, recording sheet conveyance device 30 includes trays 31, which are recording sheet storing sections to store recording sheets 32, and a drive motor, which is not illustrated.

Conveyance roller 33 represents an irregularly shaped roller, such as an eccentric roller. Regarding said irregularly shaped conveyance roller, the distance between its rotational center and the peripheral surface is not constant, in its rotational direction.

Eccentric roller 33 is a roller, wherein its rotational center varies at a predetermined length from a center of its peripheral surface, and said eccentric roller 33 is connected to conveyance roller 34 via coupling belt 35. Since conveyance roller 34 is engaged to the drive motor, when the drive motor is activated, conveyance roller 34 is rotated, and eccentric roller 33, which is entrained by coupling belt 35, is also rotated. Since the rotational center of eccentric roller 33 is configured to shift at a predetermined length from the center of the peripheral surface, peripheral velocity of eccentric roller 33 varies during the rotation so that each peripheral velocity differs between eccentric roller 33 and conveyance roller 34.

When sheet 32 is conveyed from one of trays 31 to paired registration rollers 45 through ejection rollers, which will be detailed later, said sheet 32 comes into contact with eccentric roller 33 and conveyance roller 34, to be picked up. When eccentric roller 33 and conveyance roller 34 are rotated in the sheet conveyance direction, the peripheral velocity of conveyance roller 34 is always constant, while the peripheral velocity of eccentric roller 33 always varies. Accordingly, the conveyance velocity of a part of sheet 32, which is in contact with conveyance roller 34, is constant, while the conveyance velocity of another part of sheet 32, which is in contact with eccentric roller 33, varies. Consequently, sheet 32 is puckered between eccentric roller 33 and conveyance roller 34. That is, both eccentric roller 33 and conveyance roller 34 cause a pucker in sheet 32 between eccentric roller 33 and conveyance roller 34, so that a single sheet can be invariably picked up one by one from one of trays 31, and conveyed toward paired registration rollers 45.

Sheet 32, which has been separated from the stacked sheets on any one of trays 31 by the action of eccentric roller 33 and conveyance roller 34, is conveyed toward paired registration rollers 45 through plural ejection rollers 39, wherein paired registration rollers 45 is in a stopped condition. Sheet 32 is temporarily stopped at paired registration rollers 45. While positioning the leading edge of sheet 32 to receive the toner image formed on intermediate transfer body 21, paired registration rollers 45 are controlled to start rotation, whereby sheet 32 is conveyed to secondary transfer section 22, so that the toner image is transferred onto sheet 32. After that, any toner particles remaining on intermediate transfer body 21 are removed by cleaning section 24.

Image fixing section 50 is structured of fixing roller 51 and pressure applying roller 52. Sheet 32, carrying the transferred toner image, is conveyed and nipped between fixing roller 51 and pressure applying roller 52. The transferred image on sheet 32 is heated and pressed at nipped portions, while fixing roller 51 and pressure applying roller 52 rotate, so that said image is permanently fixed on sheet 32. After that, sheet 32, now carrying the fixed image, is conveyed by paired ejection rollers to sheet ejection tray 61, which is mounted outside the apparatus.

Additionally, the above explanations concern image forming apparatus 100, which forms full-color images. However, the above explanations can also be applied to various image forming apparatuses which form monochromatic images.

[Constitutional Example of Sheet Conveyance Device 30]

Figure 2:
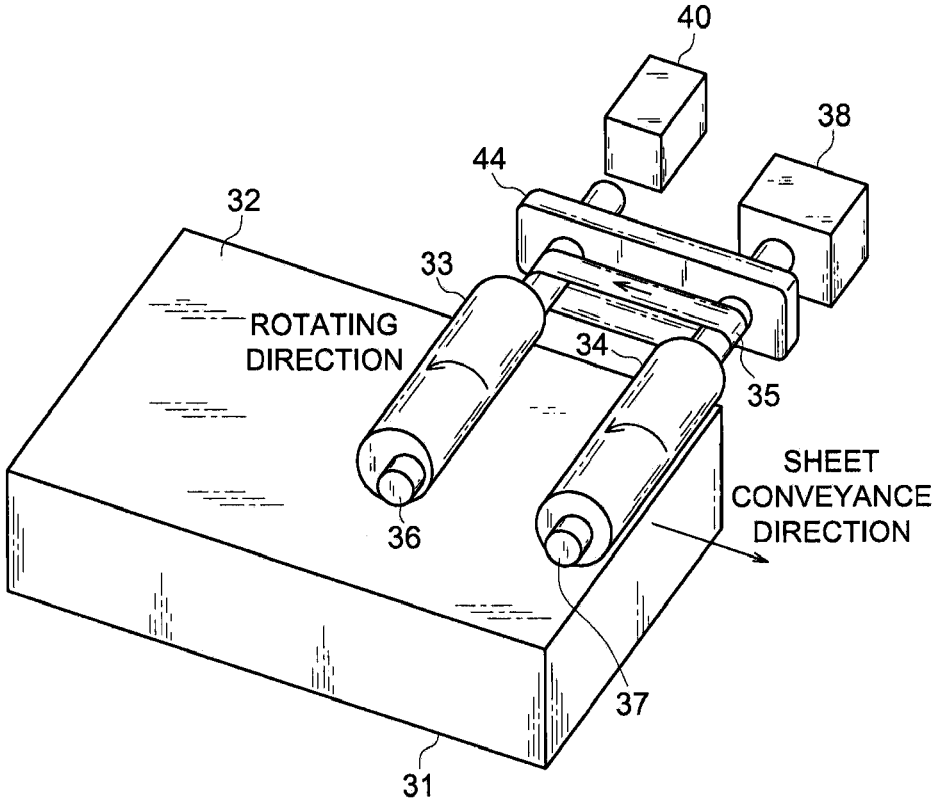
FIG. 2 is a perspective view of sheet conveyance device 30.
Figure 3:
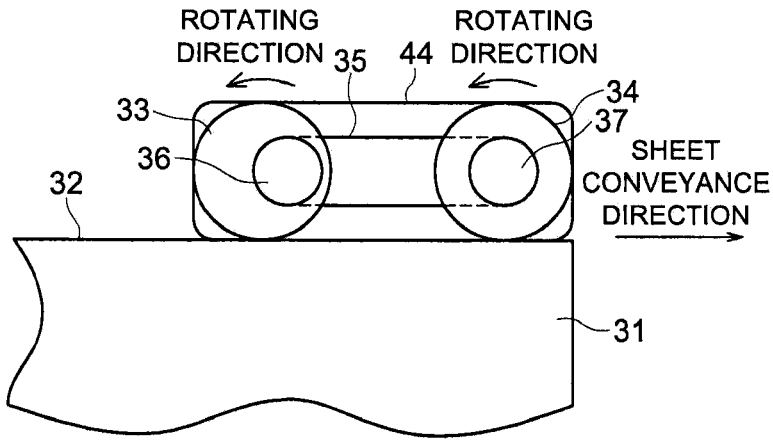
FIG. 3 is a front view of sheet conveyance device 30.
Figure 4:
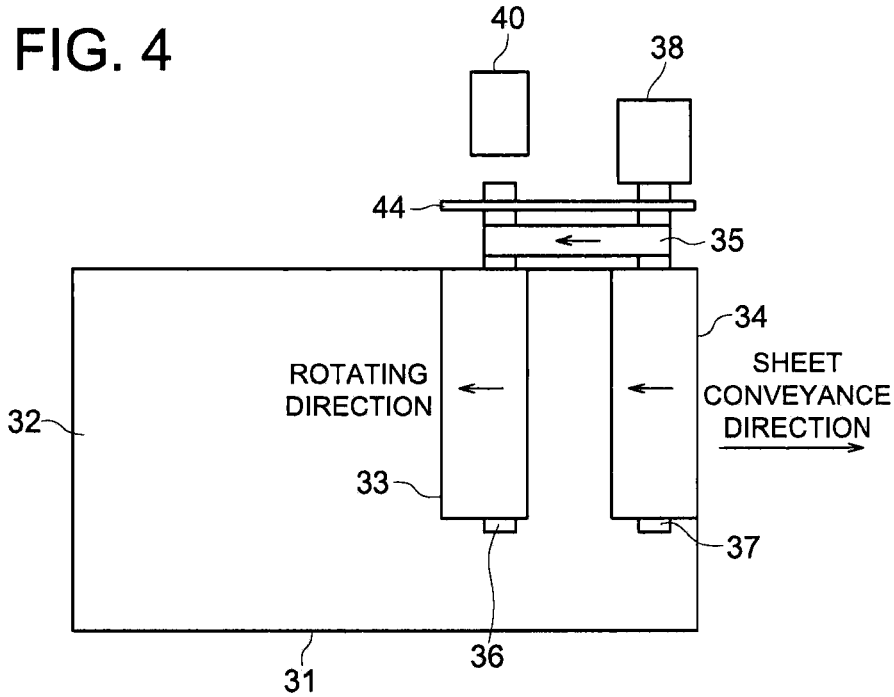
FIG. 4 is a plain view of sheet conveyance device 30.

Sheet conveyance device 30, relating to the present invention, will now be detailed. FIG. 2 is a perspective view of sheet conveyance device 30, FIG. 3 is a front view of sheet conveyance device 30, and FIG. 4 is a plain view of sheet conveyance device 30. As shown in FIGS. 2-4, sheet conveyance device 30 is structured of eccentric roller 33, conveyance roller 34 and coupling belt 35, which have already been detailed. Further, sheet conveyance device 30 includes trays 31, supporting section 44, drive motor 38, and rotating position detector 40, which detects the position of eccentric roller 33 during rotation.

Sheets 32 are stored in trays 31. Separate trays 31 are able to store sheets of various sizes, such as "size A" sheets, "size B" sheets, post card size sheets, and business card size sheets. Sheets 32 represent not only normal paper sheets, but also special media, such as coated printing sheets, OHP sheets, and the like.

Above each tray 31, eccentric 33 and conveyance roller 34 are provided, and are approximately parallel with respect to their rotational centers. Eccentric roller 33 is connected to eccentric roller shaft 36 at a position shifted from center of the peripheral circle. Conveyance roller 34 has roller shaft 37, which is centered on the peripheral circle. The peripheral length of eccentric roller 33 is desirably equal to that of conveyance roller 34. Due to these structures, both eccentric 33 and conveyance roller 34 make sheet 32 to pucker between eccentric 33 and conveyance roller 34, so that a sheet is separated by eccentric 33 and conveyance roller 34, after that, eccentric 33 and conveyance roller 34 allow said puckered sheet to smoothly flatten, and no damage is generated on sheet 32.

Coupling belt 35 is entrained about eccentric roller shaft 36, provided at one end of eccentric roller 33, and conveyance roller shaft 37, provided at one end of conveyance roller 34. As a matter of course, coupling belt 35 can also be entrained about eccentric roller shaft 36, provided at the other end of eccentric roller 33, and similarly conveyance roller shaft 37, provided at the other end of conveyance roller 34. As coupling belt 35, a resin belt or the like may be utilized.

Figure 11A:
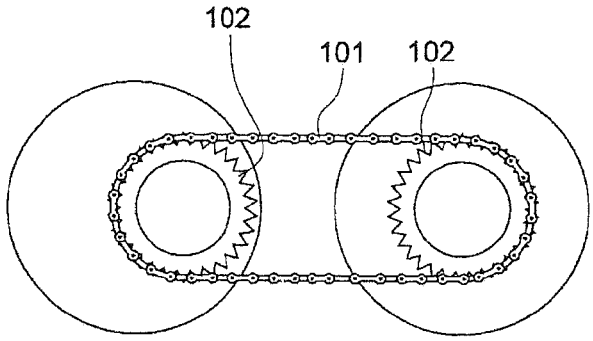
FIGS. 11A-11B show examples of possible structures to couple the eccentric roller with the conveyance roller.
Figure 11B:
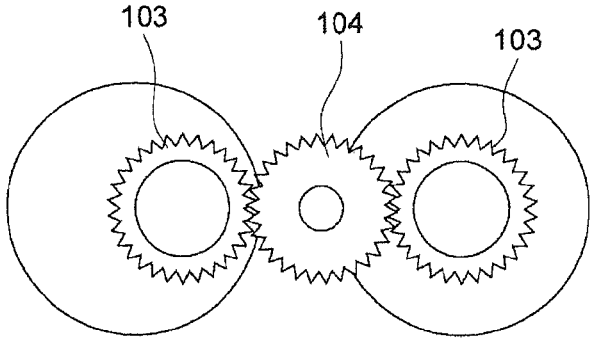

Further, instead of coupling belt 35, a chain train, including chain 101 and sprockets 102, shown in FIG. 11A or gear train, including gears 103 and gear 104, shown in FIG. 11B, can be used to couple eccentric roller 33 and conveyance roller 34. In this case, teeth must be formed on eccentric roller shaft 36 and conveyance roller shaft 37, so that each shaft can engage the chain or the gear train. Due to these structures, rotational accuracy of eccentric roller 33 and conveyance roller 34 will be improved, because the chain or the gear train exhibit more reliable power transmission which is higher than a belt.

Supporting section 44 is provided to support both eccentric roller shaft 36 and conveyance roller shaft 37. Drive motor 38 is mounted at one end of conveyance roller shaft 37. Drive motor 38 rotates conveyance roller 34 through conveyance roller shaft 37, whereby eccentric roller 33, being coupled to conveyance roller 34 through coupling belt 35, is rotated due to the rotation of conveyance roller 34. In addition, drive motor 38 may be provided at the other end of conveyance roller shaft 37.

Rotating position detector 40 is provided on eccentric roller shaft 36. For an example, a reflection type light sensor may be used for rotating position detector 40. In such detector, light beams are emitted from said reflection light sensor toward eccentric roller shaft 36, and the light beams, reflected on eccentric roller shaft 36, enter said reflection light sensor. Said reflected light beams can be precisely adjusted, whereby the intensity of the reflected light beams changes, based on the rotating positions of eccentric roller 33. That is, said reflection type light sensor can detect the rotating position of eccentric roller 33, based on the reflected light beams. Based on the detected result, before eccentric roller 33 and conveyance roller 34 have come into contact with sheet 32, eccentric roller 33 is controlled to rotate to a position (hereinafter, referred to as a "pucker-forming standard position") at which sheet 32 begins to pucker. As another structure, rotating position detector 40 can be mounted at the other end of conveyance roller 34, to detect the rotating position of said conveyance roller 34.

[Example of Operation of Sheet Conveyance Device 30]

An example of the operation of sheet conveyance device 30 will now be detailed, while referring to FIGS. 5A-5E. In said figures, eccentric roller 33 goes through a full rotation. That is, when drive motor 38 is rotated counterclockwise (see FIG. 2), being not illustrated in FIGS. 5A-5E, which motor is connected to roller shaft 37, conveyance roller 34 also rotates counterclockwise, and eccentric roller 33, coupled with conveyance roller 34 by coupling belt 35, also rotates counterclockwise. Since the peripheral velocity of eccentric roller 33 differs from that of conveyance roller 34, sheet 32 is caused to pucker between eccentric roller 33 and conveyance roller 34, as is desired.

Figure 5A:
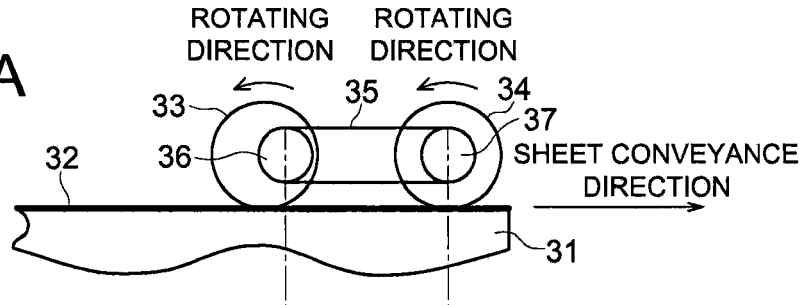
FIGS. 5A-5E show operations of sheet conveyance device 30.

In FIG. 5A, concerning eccentric roller 33, the center of eccentric roller shaft 36 is at a position which is shifted to the right from the center of a peripheral circle of eccentric roller 33. Said position represents a pucker-forming standard position. Eccentric roller 33 and conveyance roller 34 are configured to rotate counterclockwise from the pucker-forming standard position, in which sheet 32 is not puckered.

Figure 5B:
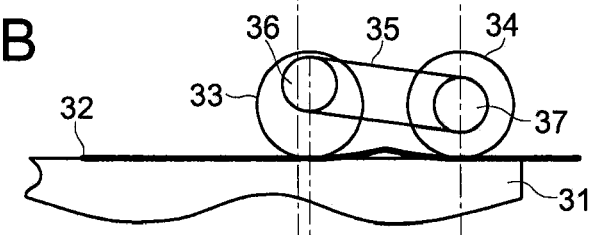

FIG. 5B shows eccentric roller shaft 36 of eccentric roller 33, which has rotated 90° counterclockwise from the pucker-forming standard position. In this condition, the peripheral velocity of eccentric roller 33 is greater than that of conveyance roller 34. Due to the difference of peripheral velocities, eccentric roller 33 and conveyance roller 34 make sheet 32 to form a pucker, between eccentric roller 33 and conveyance roller 34.

Figure 5C:
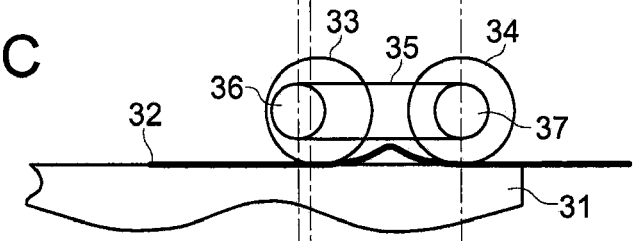

FIG. 5C shows eccentric roller shaft 36 of eccentric roller 33, which has rotated 180° counterclockwise from the pucker-forming standard position. In this condition, the pucker is greater than that shown in FIG. 5B. That is, the pucker of sheet 32 is at its maximum.

Figure 5D:
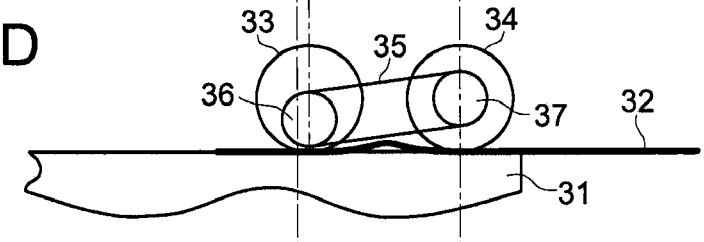

FIG. 5D shows eccentric roller shaft 36 of eccentric roller 33, which has rotated 270° counterclockwise from the pucker-forming standard position. In this condition, the peripheral velocity of eccentric roller 33 is less than that of conveyance roller 34, whereby the pucker of sheet 32 is smaller than that shown in FIG. 5C.

Figure 5E:
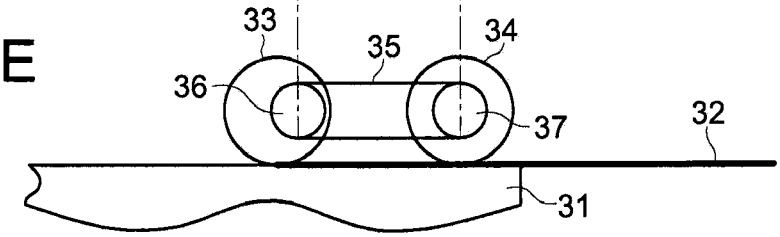

FIG. 5E shows eccentric roller shaft 36 of eccentric roller 33, which has rotated 360° counterclockwise from the pucker-forming standard position. That is, due to the full counterclockwise rotation of eccentric roller 33, sheet 32 is puckered once, whereby a single sheet 32 is separated from the top of the bundle of sheets stored in tray 31. Eccentric roller 33 and conveyance roller 34 then allow sheet 32 to flatten, and convey said sheet 32 to ejection rollers 39 (see FIG. 1). When sheet 32 is conveyed to paired registration rollers 45 through ejection rollers 39, eccentric roller 33 and conveyance roller 34 are raised above the uppermost sheet, and stand by for the next conveyance operation.

After sheet 32 has been conveyed to ejection rollers 39, eccentric roller 33 tends to have been shifted from the pucker-forming standard position. For example, after sheet 32 has been conveyed to ejection rollers 39, if eccentric roller 33 is positioned as shown in FIG. 5C, and if the next conveyance operation is started from the position shown in FIG. 5C, eccentric roller 33 tends to pull sheet 32, which may damage said sheet 32, because the peripheral velocity of eccentric roller 33 is less than that of conveyance roller 34. To overcome this problem, a one-way-clutch, which is not illustrated, may be mounted on eccentric roller 33. When the peripheral velocity of eccentric roller 33 is greater than that of conveyance roller 34, said one-way-clutch is configured to engage eccentric roller 33. When the peripheral velocity of eccentric roller 33 is less than that of conveyance roller 34, said one-way-clutch is configured to disengage eccentric roller 33, that is, eccentric roller 33 rotates freely. Due to the one-way-clutch, when the peripheral velocity of eccentric roller 33 is less than that of conveyance roller 34, the peripheral velocity of eccentric roller 33 becomes nearly equal to that of conveyance roller 34, whereby sheet 32 can be conveyed, without being damaged.

Further, as another method, the rotating position of eccentric roller 33 can be detected by above described rotating position detector 40. When sheet 32 is to be conveyed to paired registration rollers 45, after eccentric roller 33 and conveyance roller 34 have been raised, rotating position detector 40 detects a position of eccentric roller 33. Based on the detected result, eccentric roller 33 is controlled to rotate so that eccentric roller 33 is returned to the pucker-forming standard position. Due to this method, the above described one-way-clutch can be omitted.

As detailed above, by sheet conveyance device 30 relating to Embodiment 1, since eccentric roller 33 is employed, the peripheral velocity of eccentric roller 33 is variable, though that of conveyance roller 34 is always stable. That is, the conveyance velocity of sheet 32, being conveyed by eccentric roller 33, is variable, though the conveyance velocity of sheet 32, being conveyed by conveyance roller 34, is always stable. Accordingly, uppermost sheet 32 is puckered between eccentric roller 33 and conveyance roller 34, and sheet 32 is thus separated from the stacked sheets, whereby only a single sheet 32 can be reliably conveyed.

Further, since eccentric roller 33, conveyance roller 34, and coupling belt 35 are employed to separate only a single sheet 32 from the stacked sheets one by one, the number of parts required in the device is reduced, and the structure of the device becomes simple. As a result, the overall size of sheet conveyance device 30 can be downsized, and the production cost of sheet conveyance device 30 can be reduced.

Still further, since sheet conveyance device 30 is employed in image forming apparatus 100 relating to present Embodiment 1, image forming apparatus 100 can be offered at lower production costs and higher reliability of the sheet conveyance method.

<Embodiment 2>

In Embodiment 2, the operational example of sheet conveyance device 30A will be detailed. Embodiment 2 includes eccentric roller 33 and conveyance roller 34, used in sheet conveyance device 30 of Embodiment 1, but the positions of both rollers are changed relative to each other in Embodiment 2. Various parts used in Embodiment 2, whose names and identifying numbers are the same as those in Embodiment 1, and exhibit the same functions as those of Embodiment 1, so that detailed explanations for them will be omitted.

FIGS. 6A-6E show the operational example of sheet conveyance device 30A, relating to Embodiment 2. In those figures, sheet conveyance device 30A is structured of conveyance roller 33A, eccentric roller 34A, and coupling belt 35.

In FIGS. 6A-6E, eccentric roller 34A goes through a full rotation. That is, when drive motor 38 is rotated counterclockwise, which motor is connected to roller shaft 36A, conveyance roller 33A rotates counterclockwise, and eccentric roller 34A, coupled with conveyance roller 33A by coupling belt 35, also rotates counterclockwise. Since the peripheral velocity of eccentric roller 34A differs from that of conveyance roller 33A, sheet 32 is puckered between eccentric roller 34A and conveyance roller 33A, as is desired.

Figure 6A:
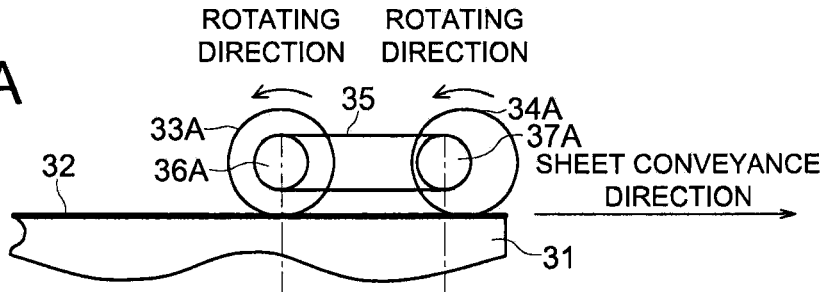
FIGS. 6A-6E show operations of sheet conveyance device 30A, relating to Embodiment 2.

In FIG. 6A, concerning eccentric roller 34A, the center of eccentric roller shaft 37A is at a position which is shifted to the left from the center of a peripheral circle of eccentric roller 34A. Said position represents a pucker-forming standard position. Eccentric roller 34A and conveyance roller 33A are configured to rotate counterclockwise from the pucker-forming standard position, in which case sheet 32 is not puckered.

Figure 6B:
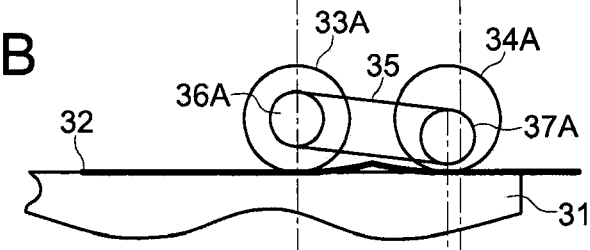

FIG. 6B shows eccentric roller shaft 37A, which has rotated 90° counterclockwise from the pucker-forming standard position. In this condition, the peripheral velocity of eccentric roller 34A is greater than that of conveyance roller 33A. Due to the difference of peripheral velocities, eccentric roller 34A and conveyance roller 33A make sheet 32 to pucker, between eccentric roller 34A and conveyance roller 33A.

Figure 6C:
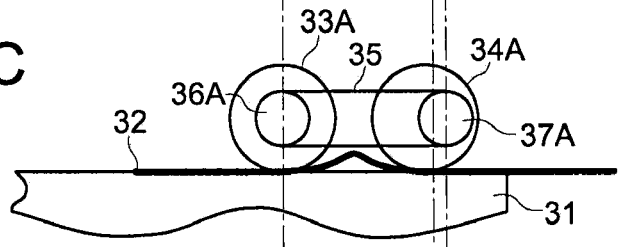

FIG. 6C shows eccentric roller shaft 37A, which has rotated 180° counterclockwise from the pucker-forming standard position. In this condition, the pucker is greater than that shown in FIG. 6B. That is, the pucker of sheet 32 is at its maximum.

Figure 6D:
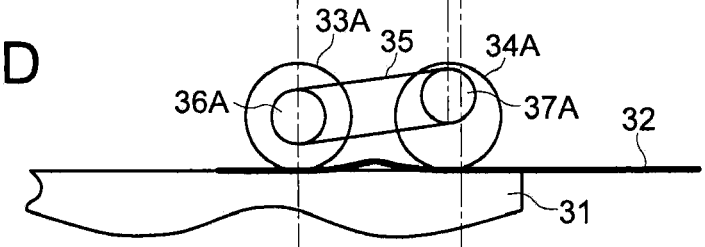

FIG. 6D shows eccentric roller shaft 37A, which has rotated 270° counterclockwise from the pucker-forming standard position. In this condition, the peripheral velocity of eccentric roller 34A is greater than that of conveyance roller 33A, whereby the pucker of sheet 32 is smaller than that shown in FIG. 6C.

Figure 6E:
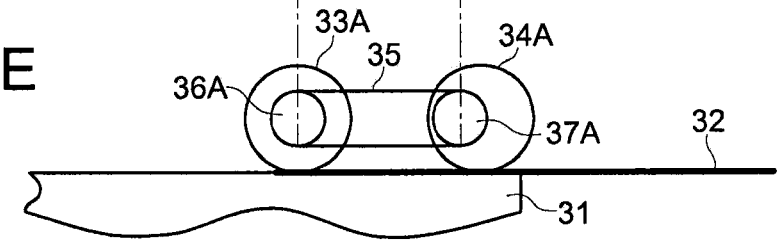

FIG. 6E shows eccentric roller shaft 37A, which has rotated 360° counterclockwise from the pucker-forming standard position. That is, due to the full counterclockwise rotation of eccentric roller 34A, a single sheet 32 is puckered once, whereby a single sheet 32 is separated from the top of the stack of sheets stored in tray 31. Eccentric roller 34A and conveyance roller 33A then allow sheet 32 to flatten, and convey said sheet 32 to ejection rollers 39 (see FIG. 1). When sheet 32 is conveyed to paired registration rollers 45 through ejection rollers 39, conveyance roller 33A and eccentric roller 34A are raised above the uppermost sheet, and stand by for the next conveyance operation.

In order to convey a subsequent sheet, rotating position detector 40 is controlled to detect the rotating position of eccentric roller 34A. Based on the result detected by above rotating position detector 40, eccentric roller 34A is rotated to the pucker-forming standard position, whereby the position of eccentric roller 34A is precisely adjusted, after which the subsequent sheet is conveyed.

According to sheet conveyance device 30A relating to Embodiment 2, the position of eccentric roller 33 and conveyance roller 34, which are placed in sheet conveyance device 30 of Embodiment 1, are exchanged within Embodiment 2, however, sheet 32 is puckered by the exchanged rollers so that sheet 32 can be picked up one by one from stacked sheets 32 stored in tray 31.

<Embodiment 3>

In Embodiment 3, conveyance roller 34 of sheet conveyance device 30 of Embodiment 1 is exchanged for another eccentric roller 34B, that is, two eccentric rollers 34B are provided on sheet conveyance device 30B of Embodiment 3. Various parts in Embodiment 3, whose names and identifying numbers are the same as those in Embodiment 1, and exhibit the same functions as those of Embodiment 1, so that detailed explanations for them will be omitted.

FIGS. 7A-7E show the example of the operation of sheet conveyance device 308 relating to Embodiment 3. Sheet conveyance device 308 is structured of a first eccentric roller (hereinafter referred to as "eccentric roller 33B"), a second eccentric roller (hereinafter referred to as "eccentric roller 34B"), and coupling belt 35.

In FIGS. 7A-7E, when drive motor 38 (being not illustrated), which is connected to a first eccentric shaft (hereinafter referred to as "eccentric roller shaft 36B"), rotates counterclockwise, so that eccentric roller 33B also rotates counterclockwise, and a second eccentric roller shaft (hereinafter referred to as "eccentric roller shaft 37B"), coupled by coupling belt 35, also rotates, so that eccentric roller 34B likewise rotates counterclockwise. Since the peripheral velocity of eccentric roller 338 differs from that of eccentric roller 34B, sheet 32 is puckered between eccentric roller 33B and eccentric roller 343. Alternatively, drive motor 38 may be coupled to eccentric roller shaft 37B.

Figure 7A:
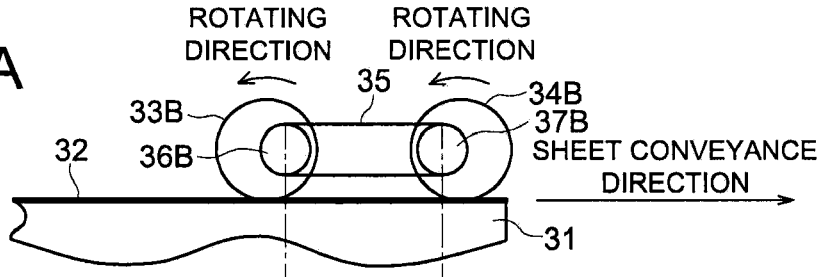
FIGS. 7A-7E show operations of sheet conveyance device 30B, relating to Embodiment 3.

In FIG. 7A, it is arranged for eccentric roller 33B to be at a position where the center of eccentric roller shaft 36B is shifted toward the right from the center of peripheral circle of eccentric roller 33B. Further, concerning eccentric roller 34B, the center of eccentric roller 37B is shifted toward the left from the center of the peripheral circle of eccentric roller 34B. Said position represents a pucker-forming standard position. Eccentric roller 33B and eccentric roller 34B are configured to rotate counterclockwise from the pucker-forming standard position.

Figure 7B:
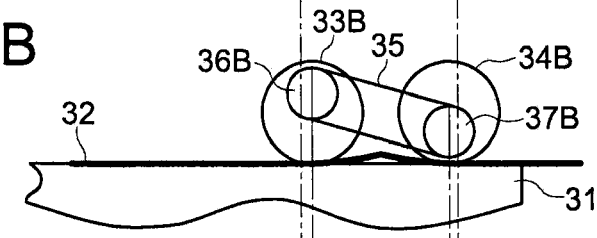

FIG. 7B shows eccentric roller shafts 36B and 37B of eccentric rollers 33B and 34B, respectively, which have rotated 90° counterclockwise from the pucker-forming standard position. In this condition, the peripheral velocity of eccentric roller 33B is greater than that of eccentric roller 34B. Due to this velocity difference, eccentric rollers 33B and 34B make sheet 32 to pucker between eccentric rollers 33B and 34B.

Figure 7C:
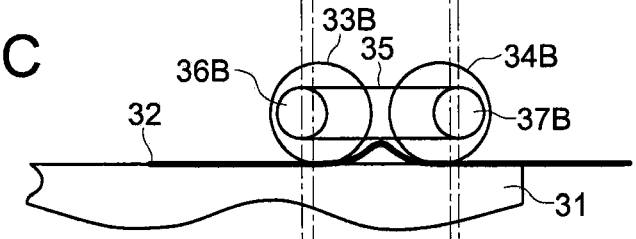

FIG. 7C shows eccentric roller shafts 36B and 37B of eccentric rollers 33B and 34B, respectively, which have rotated 180° counterclockwise from the pucker-forming standard position. In this condition, the pucker is greater than that shown in FIG. 7B, and the height of the pucker of sheet 32 is at its maximum.

Figure 7D:
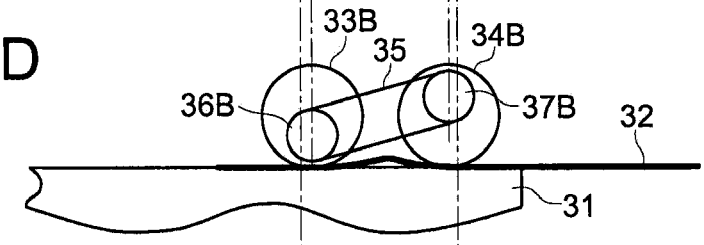

FIG. 7D shows eccentric roller shafts 36B and 37B, of eccentric rollers 33B and 34B, respectively, which have rotated 270° counterclockwise from the pucker-forming standard position. In this condition, the peripheral velocity of eccentric roller 33B is less than that of eccentric roller 34B, whereby the pucker of sheet 32 is smaller than that shown in FIG. 7C).

Figure 7E:
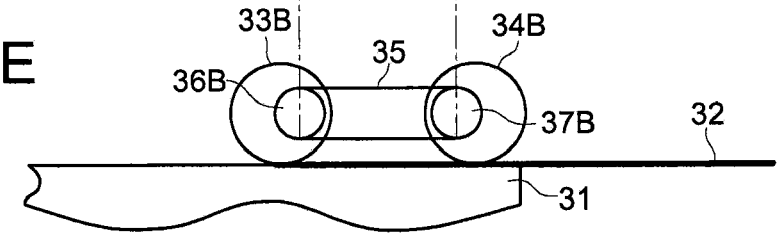

FIG. 7E shows eccentric roller shafts 36B and 37B of eccentric rollers 33B and 34B, respectively, which has rotated 360° counterclockwise from the pucker-forming standard position. That is, due to the full counterclockwise rotation of eccentric rollers 33B and 34B, a single sheet 32 is puckered once, and separated from the top of the stacked sheets 32 stored in tray 31. Eccentric rollers 33B and 34B remove the pucker from sheet 32, and convey said sheet 32 to ejection rollers 39. When sheet 32 is conveyed to paired registration rollers 45 through ejection rollers 39, eccentric rollers 33B and 34B are raised above tray 31, and stand by for the next conveyance operation.

In order to convey a subsequent sheet, rotating position detector 40 is controlled to detect the rotating position of eccentric roller 33B and/or 34B. Based on the result detected by above rotating position detector 40, eccentric rollers 33B and 343 are rotated to the pucker-forming standard position, whereby the position of eccentric rollers 33B and 34B are precisely adjusted, after which the subsequent sheet is conveyed.

In addition, a one-way-clutch, which is not illustrated, may be coupled to eccentric roller 33B. When sheet 32 is ejected to paired registration rollers 45, and when eccentric roller 333 has been positioned as shown in FIG. 7C, if subsequent sheet 32 is to be conveyed from said position, the one-way-clutch prevents eccentric roller 33B from excessively pulling said sheet 32, so that said sheet 32 can be conveyed without being damaged.

Based on sheet conveyance device 30B relating to Embodiment 3, since eccentric rollers 33B and 34B, being a total of two eccentric rollers, are used, the pucker of sheet 32 becomes taller than the pucker of the other Embodiments, whereby sheet 32 is more assuredly separated.

<Embodiment 4>

In the present Embodiment, an operational example of sheet conveyance device 30C will be detailed, in which eccentric roller 33, to structure sheet conveyance device 30 of Embodiment 1, is changed to be elliptic roller 33C. Various parts used in Embodiment 4, whose names and identifying numbers are the same as those in Embodiment 1, and exhibit the same functions as those of Embodiment 1, so that detailed explanations for them will be omitted.

FIGS. 8A-8E show operations of sheet conveyance device 30C, relating to Embodiment 4. In these figures, sheet conveyance device 30C is structured of elliptic roller 33C, conveyance roller 34, and coupling belt 35.

When drive motor 38, which is connected to roller shaft 37, rotates counterclockwise, conveyance roller 34 rotates counterclockwise, and elliptic roller 33C, which is coupled with conveyance roller 34 by coupling belt 35, also rotates counterclockwise. Since the peripheral velocity of elliptic roller 33C differs from that of conveyance roller 34, sheet 32 is puckered between elliptic roller 33C and conveyance roller 34. The periphery of elliptic roller 33C exhibits an ellipsoid. Further, its peripheral length is configured to be equal to that of conveyance roller 34. Due to this structure, after sheet S32 has been puckered, said sheet 32 is caused to flatten, and is conveyed without being damaged.

Figure 8A:
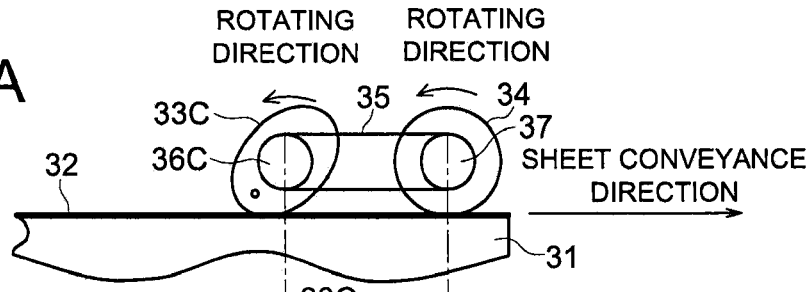
FIGS. 8A-8E show operations of sheet conveyance device 30C, relating to Embodiment 4.

In FIG. 8A, the long axis of said elliptic roller 33C has been rotated 45° counterclockwise from the horizontal position, this rotated position of elliptic roller 33C represents a pucker-forming standard position. Elliptic roller 33C and conveyance roller 34 are configured to rotate counterclockwise from the pucker-forming standard position, in which sheet 32 is not puckered.

Figure 8B:
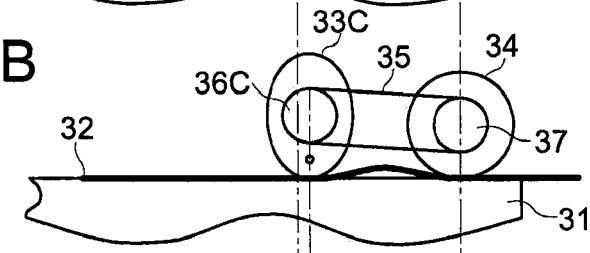

FIG. 8B shows elliptic roller shaft 36C of elliptic roller 33C, which has rotated 45° counterclockwise from the pucker-forming standard position. In this condition, the peripheral velocity of elliptic roller 33C is greater than that of conveyance roller 34. Due to the difference of peripheral velocities, elliptic roller 33C and conveyance roller 34 make sheet 32 to pucker between elliptic roller 33C and conveyance roller 34.

Figure 8C:
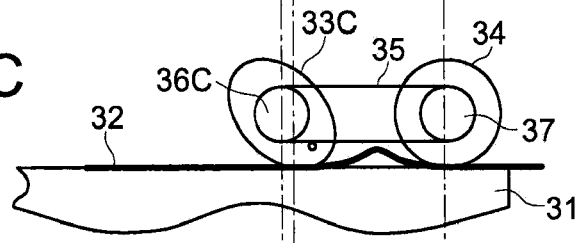

FIG. 8C shows elliptic roller shaft 36C of elliptic roller 33C, which has rotated 90° counterclockwise from the pucker-forming standard position. In this condition, the pucker is greater than that shown in FIG. 8B. That is, the pucker of sheet 32 is at its maximum, but is less than the pucker formed by eccentric roller 33 shown in FIG. 5C.

Figure 8D:
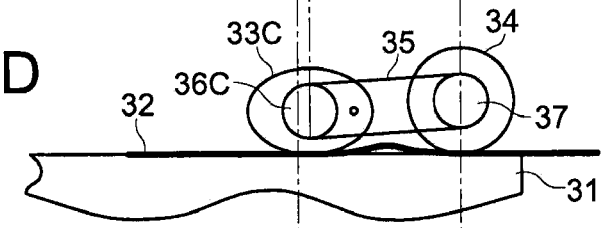

FIG. 8D shows elliptic roller shaft 36C of elliptic roller 33C, which has rotated 135° counterclockwise from the pucker-forming standard position. In this condition, the peripheral velocity of elliptic roller 33C is less than that of conveyance roller 34, whereby the pucker of sheet 32 becomes less than the pucker shown in FIG. 8C.

Figure 8E:
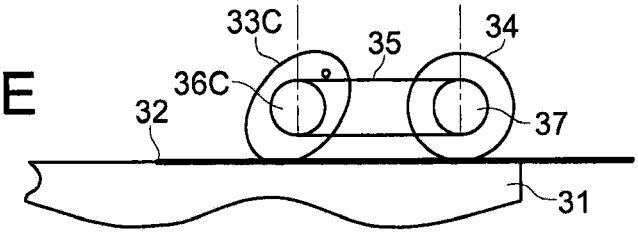

FIG. 8E shows elliptic roller shaft 36C of elliptic roller 33C, which has rotated 180° counterclockwise from the pucker-forming standard position. That is, due to 180° counterclockwise rotation of elliptic roller 33C, a single sheet 32 is puckered once, and thus separated from the top of the bundle of sheets stored in tray 31. Elliptic roller 33C and conveyance roller 34 then allow sheet 32 to flatten, and convey said sheet 32 to ejection rollers 39. When sheet 32 is conveyed, through ejection rollers 39, to paired registration rollers 45, elliptic roller 33 and conveyance roller 34 are raised above the uppermost sheet, and stand by for the next conveyance operation.

In order to convey a subsequent sheet, rotating position detector 40 is controlled to detect the rotating position of elliptic roller 33C. Based on the result detected by above rotating position detector 40, elliptic roller 33C is rotated to the pucker-forming standard position, whereby the position of eccentric roller 33C is precisely adjusted, after which the subsequent sheet is conveyed.

As another structure, in a case that sheet 32 is to be conveyed to paired registration rollers 45, if elliptic roller 33C is at the position shown in FIG. 8C, when subsequent sheet 32 is conveyed from said position, the one-way-clutch prevents elliptic roller 33C from excessively pulling said sheet 32, so that said sheet 32 can be conveyed without being damaged.

Due to a 180° rotation of elliptic roller 33C, a single pucker is formed on sheet 32. That is, elliptic roller 33C can form a pucker two times by the full rotation.

In Embodiment 4, elliptic roller 33C is mounted on the upstream side with respect to the sheet conveyance direction, while conveyance roller 34 is mounted on the downstream side, with respect to the sheet conveyance direction. However, elliptic roller 33C may be mounted on the downstream side, with respect to the sheet conveyance direction, while conveyance roller 34 may be mounted on the upstream side, with respect to the sheet conveyance direction. Alternatively, two elliptic rollers 33C may be employed.

According to sheet conveyance device 30C relating to Embodiment 4, since elliptic roller 33C and conveyance roller 34 are employed to form a pucker, the pucker can be formed two times by the full rotation of elliptic roller 33C, whereby the sheet is more assuredly separated.

<Embodiment 5>

In the present Embodiment, an operational example of sheet conveyance device 30D will be detailed, in which eccentric roller 33, as a structure of sheet conveyance device 30 of Embodiment 1, is changed to triangular roller 33D. Various parts used in Embodiment 5, whose names and identifying numbers are the same as those in Embodiment 1, and exhibit the same functions as those of Embodiment 1, so that detailed explanations for them will be omitted.

FIGS. 9A-9E show the operational example of sheet conveyance device 30D, relating to Embodiment 5. In those figures, sheet conveyance device 30D is structured of triangular roller 33D, conveyance roller 34, and coupling belt 35.

In FIGS. 9A-9E, when drive motor 38 is rotated counterclockwise, which is connected to roller shaft 37, conveyance roller 34 rotates counterclockwise, and triangular roller 33D, coupled with conveyance roller 34 by coupling belt 35, also rotates counterclockwise. Since the peripheral velocity of triangular roller 33D differs from that of conveyance roller 34, sheet 32 is puckered between triangular roller 33D and conveyance roller 34. The peripheral shape of triangular roller 33D is configured to exhibit a triangle with rounded apexes. Further, its peripheral length is designed to be equal to that of conveyance roller 34. Due to these structures, after sheet 32 has been puckered, said sheet 32 is smoothly flattened, whereby sheet 32 can be conveyed without being damaged.

Figure 9A:
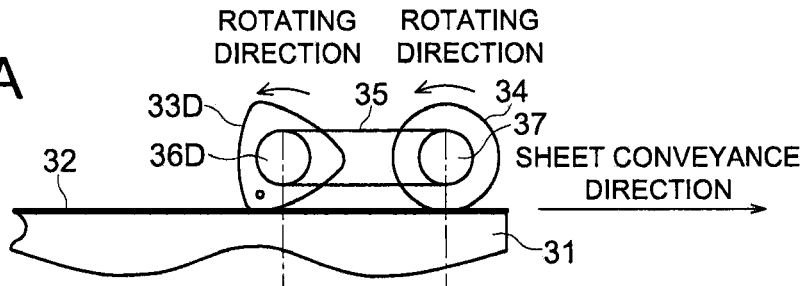
FIGS. 9A-9E show operations of sheet conveyance device 30D, relating to Embodiment 5.

In FIG. 9A, a side of triangular roller 33D has been rotated 30° counterclockwise from the horizontal position. This rotated position of triangular roller 330 represents a pucker-forming standard position. Triangular roller 33D and conveyance roller 34 are configured to rotate counterclockwise from the pucker-forming standard position.

Figure 9B:
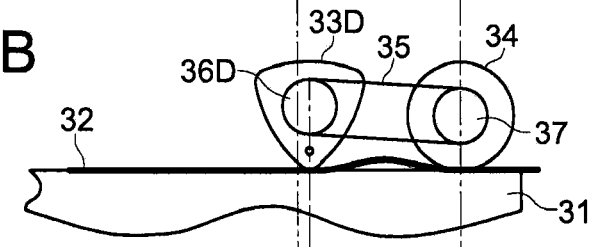

FIG. 9B shows triangular roller shaft 36D, which has rotated 30° counterclockwise from the pucker-forming standard position. In this condition, the peripheral velocity of triangular roller 33D is greater than that of conveyance roller 34. Due to this difference of peripheral velocities, triangular roller 33D and conveyance roller 34 make sheet 32 to pucker, between triangular roller 33D and conveyance roller 34.

Figure 9C:
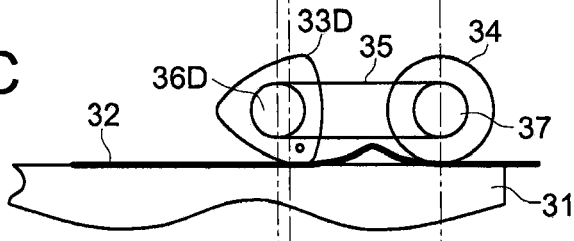

FIG. 9C shows eccentric roller shaft 36, which has rotated 60° counterclockwise from the pucker-forming standard position. In this condition, the pucker is greater than that shown in FIG. 9B. That is, the pucker of sheet 32 is at its maximum, but is less than that of Embodiment 1.

Figure 9D:
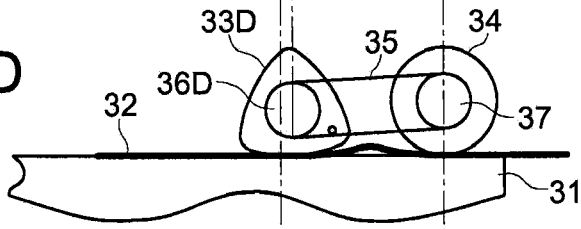

FIG. 9D shows triangular roller shaft 37A of triangular roller 33D, which has rotated 90° counterclockwise from the pucker-forming standard position. In this condition, the peripheral velocity of triangular roller 33D is less than that of conveyance roller 34, whereby the pucker of sheet 32 becomes less than that shown in FIG. 9C.

Figure 9E:
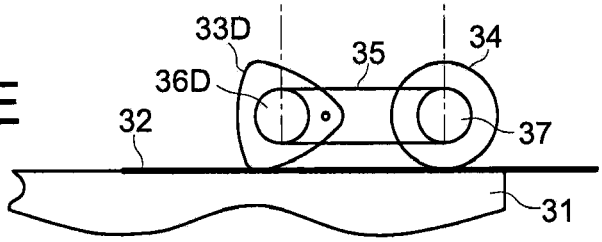

FIG. 9E shows triangular roller shaft 36D, which has rotated 120° counterclockwise from the pucker-forming standard position. That is, due to said 120° counterclockwise rotations of triangular roller 33D and conveyance roller 34, sheet 32 is puckered once, whereby only a single sheet 32 is separated from the top of the bundle of sheets stored in tray 31. Triangular roller 33D and conveyance roller 34 then allow said sheet 32 to flatten, and convey said sheet 32 to ejection rollers 39. When sheet 32 is conveyed to paired registration rollers 45 through ejection rollers 39, conveyance roller 34 and triangular roller 34A are raised above the uppermost sheet, and stand by for the next conveyance operation.

In order to convey a subsequent sheet, rotating position detector 40 is controlled to detect the rotating position of triangular roller 33D. Based on the detected result by above rotating position detector 40, triangular roller 33D is rotated to the pucker-forming standard position, whereby the position of triangular roller 33D is precisely adjusted, and the subsequent sheet is then conveyed.

In addition, a one-way-clutch, which is not illustrated, may be coupled to triangular roller 33D. When sheet 32 is to be ejected to paired registration rollers 45, and when triangular roller 33D has been positioned as shown in FIG. 9C, if subsequent sheet 32 is to be conveyed from said position, the one-way-clutch prevents triangular roller 33D from excessively pulling said sheet 32, so that said sheet 32 can be conveyed without being damaged.

Due to a 120° rotation of triangular roller 33D, a single pucker is formed on sheet 32. That is, triangular roller 33D can form a pucker three times by the full rotation.

In Embodiment 5, triangular roller 33D is mounted on the upstream side, with respect to the sheet conveyance direction, while conveyance roller 34 is mounted on the downstream side, with respect to the sheet conveyance direction. Alternatively, triangular roller 33D may be mounted on the downstream side, with respect to the sheet conveyance direction, while conveyance roller 34 may be mounted on the upstream side, with respect to the sheet conveyance direction. Further, two triangular rollers 33D may be employed.

According to sheet conveyance device 30D relating to Embodiment 5, since triangular roller 33D and conveyance roller 34 are employed to form the pucker, the pucker can be formed three times on a single sheet by the full rotation of triangular roller 33D, whereby the sheet is more assuredly separated.

<Embodiment 6>

In the present Embodiment, an operational example of sheet conveyance device 30E will be detailed, in which a second eccentric roller is further added to Embodiment 2. Accordingly, Embodiment 6 is structured of three rollers. Various parts used in Embodiment 6, whose names and identifying numbers are the same as those in Embodiment 2, and exhibit the same functions as those of Embodiment 2, so that detailed explanations for them will be omitted.

FIGS. 10A-10E show the operational example of sheet conveyance device 30E, relating to Embodiment 6. In those figures, sheet conveyance device 30E is structured of conveyance roller 33, a first eccentric roller (hereinafter referred to as "eccentric roller 34E"), a second eccentric roller (hereinafter referred to as "eccentric roller 41"), and coupling belts 35 and 43.

In FIGS. 10A-10E, when drive motor 38 is rotated counterclockwise, which motor is connected to roller shaft 36E, conveyance roller 33E is rotated counterclockwise. Accordingly, a first eccentric roller shaft (hereinafter referred to as "eccentric roller shaft 37E"), coupled by coupling belt 35, is also rotated, so that eccentric roller 34E is rotated counterclockwise. Further, a second eccentric roller shaft (hereinafter referred to as "eccentric roller shaft 42"), coupled by coupling belt 43, is also rotated, so that eccentric roller 41 is rotated counterclockwise. Since the peripheral velocity of eccentric rollers 34E and 41 differ to that of conveyance roller 33E, sheet 32 is puckered between eccentric roller 34E and conveyance roller 33E, as well as between eccentric roller 41 and conveyance roller 33E.

In FIG. 6A, concerning eccentric roller 34E, the center of eccentric roller shaft 37E is at a position which is shifted to the left from the center of a peripheral circle of eccentric roller 34E. Further, concerning eccentric roller 41, the center of eccentric roller shaft 42 is at a position which is shifted to the right from the center of a peripheral circle of eccentric roller 41. Above described two positions represent pucker-forming standard positions, at which positions no pucker is generated. Eccentric rollers 34E and 41, and conveyance roller 33E are configured to rotate counterclockwise from the pucker-forming standard positions.

Figure 10A:
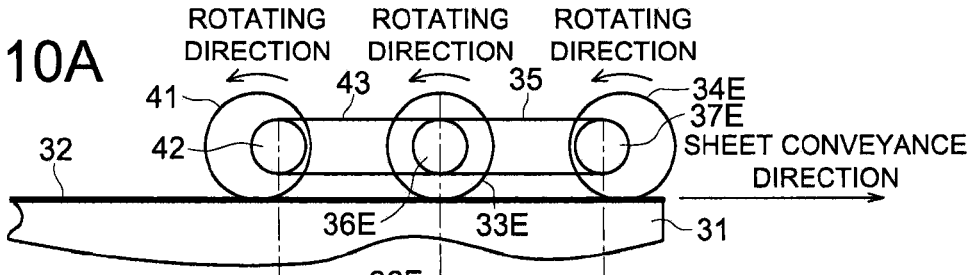
FIGS. 10A-10E show operations of sheet conveyance device 30E, relating to Embodiment 6.
Figure 10B:
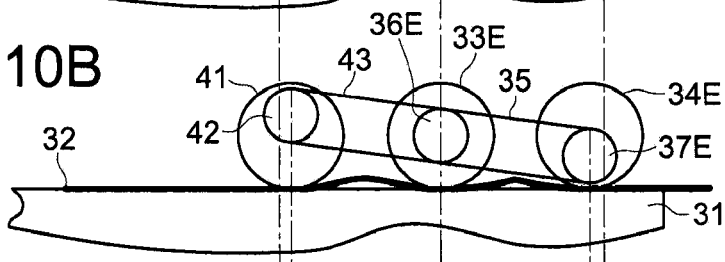
Figure 10C:
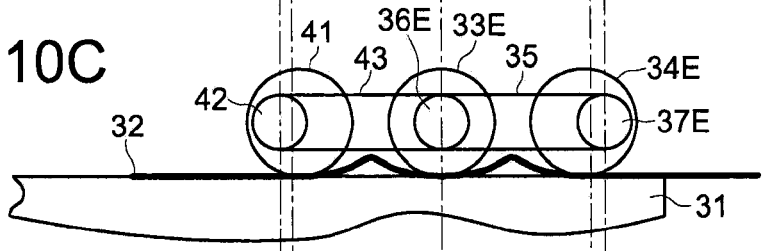

FIG. 10B shows eccentric roller shafts 37E and 42, which have rotated 90° counterclockwise from the pucker-forming standard positions, respectively. In these conditions, the peripheral velocity of eccentric roller 34E is less than that of conveyance roller 33E, while the peripheral velocity of eccentric roller 41 is greater than that of conveyance roller 33E. Due to these different peripheral velocities, eccentric rollers 34E and 41, and conveyance roller 33E make sheet 32 to pucker between eccentric roller 34E and conveyance roller 33A, as well as between eccentric roller 41 and conveyance roller 33E.

FIG. 6C shows eccentric roller shaft 37E and 42, which have rotated 180° counterclockwise from the pucker-forming standard positions. In these conditions, the puckers are greater than the puckers shown in FIG. 10B. That is, the puckers of sheet 32 are at their maximum.

Figure 10D:
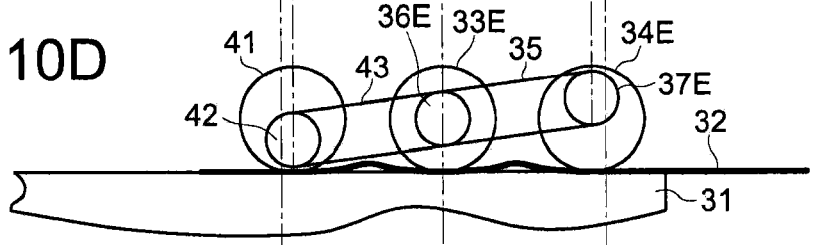

FIG. 10D shows eccentric roller shafts 37E and 42, which have rotated 270° counterclockwise from the pucker-forming standard positions. In this condition, the peripheral velocity of eccentric roller 34E is greater than that of conveyance roller 33E, while peripheral velocity of eccentric roller 41 is less than that of conveyance roller 33E, whereby the puckers of sheet 32 become less than the puckers shown in FIG. 10C.

Figure 10E:
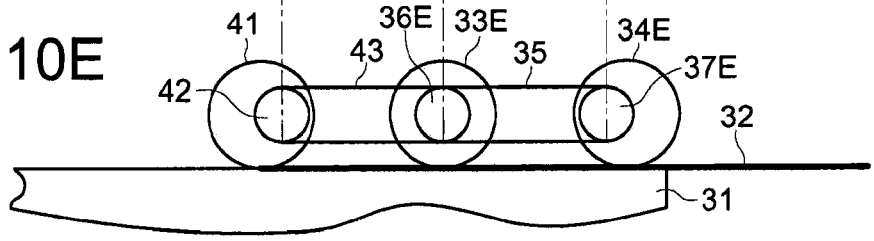

FIG. 10E shows eccentric roller shaft 37E and 42, which have rotated 360° counterclockwise from the pucker-forming standard positions. That is, due to the full counterclockwise rotations of eccentric rollers 34E and 41, and conveyance roller 33E, sheet 32 is puckered between eccentric roller 34E and conveyance roller 33E, while sheet 32 is also puckered between eccentric roller 41 and conveyance roller 33E. That is, due to the full counterclockwise rotations of eccentric rollers 34E and 41, and conveyance roller 33E, sheet 32 is puckered at two portions, so that only a single sheet 32 is more assuredly separated from the top of the bundle of sheets stored in tray 31. Eccentric rollers 34E and 41, and conveyance roller 33E then allow sheet 32 to flatten, and convey said sheet 32 to ejection rollers 39. When sheet 32 is to be conveyed to paired registration rollers 45 through ejection rollers 39, conveyance roller 33E, and eccentric rollers 34E and 41 are raised above the uppermost sheet in tray 31, and stand by for the next conveyance operation.

In order to convey a subsequent sheet, rotating position detector 40 is controlled to detect the rotating position of eccentric rollers 34E and 41. Based on the detected result by above rotating position detector 40, eccentric rollers 34E and 41 are rotated to the pucker-forming standard positions, whereby the positions of eccentric roller 34E and 41 are precisely adjusted, the subsequent sheet is then conveyed.

In Embodiment 6, two eccentric rollers are employed in the sheet conveyance device. As other structures, irregularly shaped rollers, such as elliptic rollers, and triangular rollers, can be employed.

According to sheet conveyance device 30E, relating to Embodiment 6, eccentric rollers 33E and 41 and conveyance roller 33E are employed to form two puckers on sheet 32. During the full rotation of eccentric rollers 34E and 41, two puckers are formed so that sheet 32 is more assuredly separated.

Concerning the industrial application of the present invention, the present invention is extremely effective in the sheet conveyance device and the image forming apparatus, in which the uppermost sheet of the stacked sheets is puckered, so that only a single sheet can be separated from the stacked sheets.

What is claimed is:

1. A sheet conveyance device to convey a sheet which is stored within a sheet storing section, comprising:

a plurality of sheet conveyance rollers, mounted on the sheet storing section, to be parallel to each other with respect to rotating centers, wherein the plurality of the sheet conveyance rollers come into contact with the sheet to convey the sheet toward an exterior of the sheet conveyance device;

a coupling section to couple the plurality of the sheet conveyance rollers with each other and to rotate the plurality of the sheet conveyance rollers; and a detecting section provided on an eccentric roller, wherein at least one of the plurality of the sheet conveyance rollers includes the eccentric roller, wherein the eccentric roller is coupled to another sheet conveyance roller by the coupling section, wherein a distance between a rotation center and a peripheral surface of the eccentric roller changes continuously in a rotational direction of the eccentric roller;

wherein the peripheral length of the eccentric roller is equal to the peripheral length of the other sheet conveyance roller, so that the sheet is puckered between the eccentric roller and the other sheet conveyance roller, and wherein the detecting section detects a rotating position of the eccentric roller.

2. The sheet conveyance device of claim 1, wherein the coupling section is selected to be used, among at least one of a belt, a chain, and a gear train.

3. An image forming apparatus, comprising:

an image forming section to form an image on an image carrier; and a sheet conveyance device to supply successive sheets to the image carrier, wherein the sheet conveyance device includes a plurality of conveyance rollers mounted on a sheet storing section, to be parallel to each other with respect to rotating centers, wherein the plurality of the sheet conveyance rollers come into contact with the sheet to convey the sheet to the image carrier;

a coupling section to couple the plurality of the sheet conveyance rollers with each other and to rotate the plurality of the sheet conveyance rollers; and, a detecting section provided on an eccentric roller, wherein at least one of the plurality of the sheet conveyance rollers includes the eccentric roller, wherein the eccentric roller is coupled to another sheet conveyance roller by the coupling section, wherein a distance between a rotation center and a peripheral surface of the eccentric roller changes continuously in a rotational direction of the eccentric roller;

wherein the peripheral length of the eccentric roller is equal to the peripheral length of the other sheet conveyance roller, so that the sheet is puckered between the eccentric roller and other sheet conveyance roller; and wherein the detecting section detects a rotating position of the eccentric roller.

* * * * *